US010748488B2

(12) United States Patent
Lee

(10) Patent No.: US 10,748,488 B2
(45) Date of Patent: Aug. 18, 2020

(54) DISPLAY DEVICE AND A METHOD FOR DRIVING THE SAME

(71) Applicant: SAMSUNG DISPLAY CO., LTD., Yongin-si, Gyeonggi-Do (KR)

(72) Inventor: Hee Chul Lee, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 16/178,984

(22) Filed: Nov. 2, 2018

(65) Prior Publication Data

US 2019/0311678 A1 Oct. 10, 2019

(30) Foreign Application Priority Data

Apr. 10, 2018 (KR) ..... 10-2018-0041736

(51) Int. Cl.
*G09G 3/3258* (2016.01)

(52) U.S. Cl.
CPC ..... *G09G 3/3258* (2013.01); *G09G 2330/021* (2013.01); *G09G 2360/144* (2013.01)

(58) Field of Classification Search
CPC ..... G09G 3/3258; G09G 2360/144; G09G 2330/021; G09G 2330/028; G09G 3/3233
See application file for complete search history.

(56) References Cited

U.S. PATENT DOCUMENTS 8,698,854 B2 4/2014 Lee
2006/0109218 A1* 5/2006 Kim ..... G09G 3/3216 345/77
2009/0109147 A1* 4/2009 Park ..... G09G 3/20 345/76
2010/0295877 A1* 11/2010 Yun ..... G09G 3/3406 345/690
2012/0218252 A1* 8/2012 Yamauchi ..... G09G 3/36 345/212
2014/0374572 A1* 12/2014 Kim ..... H04N 5/3745 250/208.1
2016/0041531 A1* 2/2016 Mackie ..... A61B 5/0059 368/80
2016/0133223 A1* 5/2016 Kim ..... G09G 3/3225 345/211
2016/0372028 A1* 12/2016 Park ..... G09G 3/2096
(Continued)

FOREIGN PATENT DOCUMENTS

KR 10-1323390 10/2013
KR 10-2017-0071203 6/2017

*Primary Examiner* — Premal R Patel
(74) *Attorney, Agent, or Firm* — F. Chau & Associates, LLC

(57) ABSTRACT

A display device including: a display panel including a plurality of pixels configured to be driven in a normal mode or an always on display mode; an illuminance sensor configured to detect illuminance of ambient light; a direct current (DC)-DC converter configured to supply a power supply voltage having a first voltage level to the pixels through a power supply line when the illuminance is greater than a predetermined reference value in the always on display mode; and a display panel driver configured to supply a power supply voltage having a second voltage level to the pixels through the power supply line when the illuminance is less than or equal to the predetermined reference value in the always on display mode.

20 Claims, 7 Drawing Sheets

(56) References Cited

U.S. PATENT DOCUMENTS

| | | | | |
|---|---|---|---|---|
| 2017/0103728 | A1* | 4/2017 | Chen | G09G 3/2003 |
| 2017/0116950 | A1* | 4/2017 | Onal | G09G 3/3696 |
| 2018/0061322 | A1* | 3/2018 | Yim | G09G 3/3233 |
| 2018/0096666 | A1* | 4/2018 | Chung | G09G 3/3688 |

* cited by examiner

DISPLAY DEVICE AND A METHOD FOR DRIVING THE SAME

CROSS REFERENCE TO RELATED APPLICATION

This application claims priority under 35 U.S.C. 119 to Korean Patent Application No. 10-2018-0041736, filed on Apr. 10, 2018 in the Korean Intellectual Property Office (KIPO), the disclosure of which is incorporated by reference herein in its entirety.

1. TECHNICAL FIELD

Exemplary embodiments of the inventive concept relate to display devices. More particularly, exemplary embodiments of the inventive concept relate to display devices for controlling a power supply mode and methods for driving the same.

2. DISCUSSION OF RELATED ART

A display device includes a direct current (DC)-DC converter that generates a high-potential power voltage and a low-potential power voltage for driving pixels. For example, the DC-DC converter generates the high and low potential power voltages by converting an input power supplied from a power source such as an external battery or the like. The DC-DC converter supplies the generated high-potential (e.g., positive) power voltage and low-potential (e.g., negative) power voltage to the pixels through a power supply line.

SUMMARY

According to an exemplary embodiment of the inventive concept, a display device may comprise a display panel including a plurality of pixels configured to be driven in a normal mode or an always on display mode; an illuminance sensor configured to detect illuminance of ambient light; a direct current (DC)-DC converter configured to supply a power supply voltage having a first voltage level to the pixels through a power supply line when the illuminance is greater than a predetermined reference value in the always on display mode; and a display panel driver configured to supply a power supply voltage having a second voltage level to the pixels through the power supply line when the illuminance is less than or equal to the predetermined reference value in the always on display mode.

In an exemplary embodiment of the inventive concept, the DC-DC converter may be disabled when the illuminance is less than or equal to the predetermined reference value in the always on display mode.

In an exemplary embodiment of the inventive concept, the display panel driver may be electrically disconnected from the power supply line when the illuminance is greater than the predetermined reference value in the always on display mode.

In an exemplary embodiment of the inventive concept, a maximum luminance of the display panel when the DC-DC converter supplies the power supply voltage may be higher than a maximum luminance of the display panel when the display panel driver supplies the power supply voltage.

In an exemplary embodiment of the inventive concept, the second voltage level may be less than the first voltage level.

In an exemplary embodiment of the inventive concept, the DC-DC converter may supply the power supply voltage to the power supply line in the normal mode, and the display panel driver may be electrically disconnected from the power supply line in the normal mode.

In an exemplary embodiment of the inventive concept, the display panel driver may comprise a scan driver configured to supply a scan signal to the pixels through a plurality of scan lines; a data driver configured to supply a data signal to the pixels through a plurality of data lines; and a controller configured to control the scan driver and the data driver.

In an exemplary embodiment of the inventive concept, the power supply voltage supplied from the display panel driver may be generated from a gate high voltage of the scan signal.

In an exemplary embodiment of the inventive concept, the power supply voltage supplied from the display panel driver may be generated from a DC voltage provided to the data driver.

In an exemplary embodiment of the inventive concept, the display panel driver may change a magnitude of the power supply voltage according to an illuminance change when the illuminance is less than or equal to the predetermined reference value in the always on display mode.

In an exemplary embodiment of the inventive concept, the power supply voltage may be reduced as the illuminance is reduced, when the illuminance is less than or equal to the predetermined reference value in the always on display mode.

In an exemplary embodiment of the inventive concept, a maximum luminance may be reduced as the illuminance is reduced, in the always on display mode.

In an exemplary embodiment of the inventive concept, the DC-DC converter may control a magnitude of the power supply voltage according to the illuminance.

In an exemplary embodiment of the inventive concept, the power supply voltage output from the DC-DC converter may be reduced as the illuminance is reduced, in the normal mode.

According to an exemplary embodiment of the inventive concept, a method for driving a display device may comprise selecting one of a normal mode and an always on display mode; detecting an illuminance of ambient light in the always on display mode; and supplying a power supply voltage to a plurality of pixels by using one of a DC-DC converter and a display panel driver in response to the selected mode and the detected illuminance.

In an exemplary embodiment of the inventive concept, when supplying the power supply voltage to the pixels, the DC-DC converter supplies the power supply voltage having a first voltage level to the pixels through a power supply line when the illuminance is greater than a predetermined reference value in the always on display mode.

In an exemplary embodiment of the inventive concept, when supplying the power supply voltage to the pixels, the display panel driver supplies the power supply voltage having a second voltage level to the pixels through the power supply line when the illuminance is less than or equal to the predetermined reference value in the always on display mode.

In an exemplary embodiment of the inventive concept, a maximum luminance of the display panel when the DC-DC converter supplies the power supply voltage may be higher than a maximum luminance of the display panel when the display panel driver supplies the power supply voltage.

In an exemplary embodiment of the inventive concept, the second voltage level may be less than the first voltage level, and the power supply voltage may be transmitted to a driving transistor of each of the pixels.

In an exemplary embodiment of the inventive concept, when supplying the power supply voltage to the pixels, the DC-DC converter supplies the power supply voltage to the power supply line in the normal mode and the display panel driver is electrically disconnected from the power supply line in the normal mode.

According to an exemplary embodiment of the inventive concept, there is provided a display device including: a display panel including a plurality of pixels configured to be driven in a first display mode or a second display mode; an illuminance sensor configured to detect illuminance of ambient light; a DC-DC converter configured to supply a power supply voltage having a first voltage level to the pixels through a power supply line when the illuminance is greater than a predetermined reference value in the second display mode; and a display panel driver configured to supply a power supply voltage having a second voltage level to the pixels through the power supply line when the illuminance is less than or equal to the predetermined reference value in the second display mode.

In an exemplary embodiment of the inventive concept, the first and second display modes are different from each other.

In an exemplary embodiment of the inventive concept, the first display mode is a normal display mode and the second display mode is an always on display mode.

In an exemplary embodiment of the inventive concept, in the always on display mode, a portion of the display panel is kept on during a sleep mode.

In an exemplary embodiment of the inventive concept, in the always on display mode, a portion of a screen of the display panel displays an image during a sleep mode.

BRIEF DESCRIPTION OF THE DRAWINGS

The above and other features of the inventive concept will become more apparent by describing in detail exemplary embodiments thereof with reference to the accompanying drawings.

DETAILED DESCRIPTION OF THE EMBODIMENTS

Exemplary embodiments of the inventive concept will be described more fully hereinafter with reference to the accompanying drawings.

Figure 1:
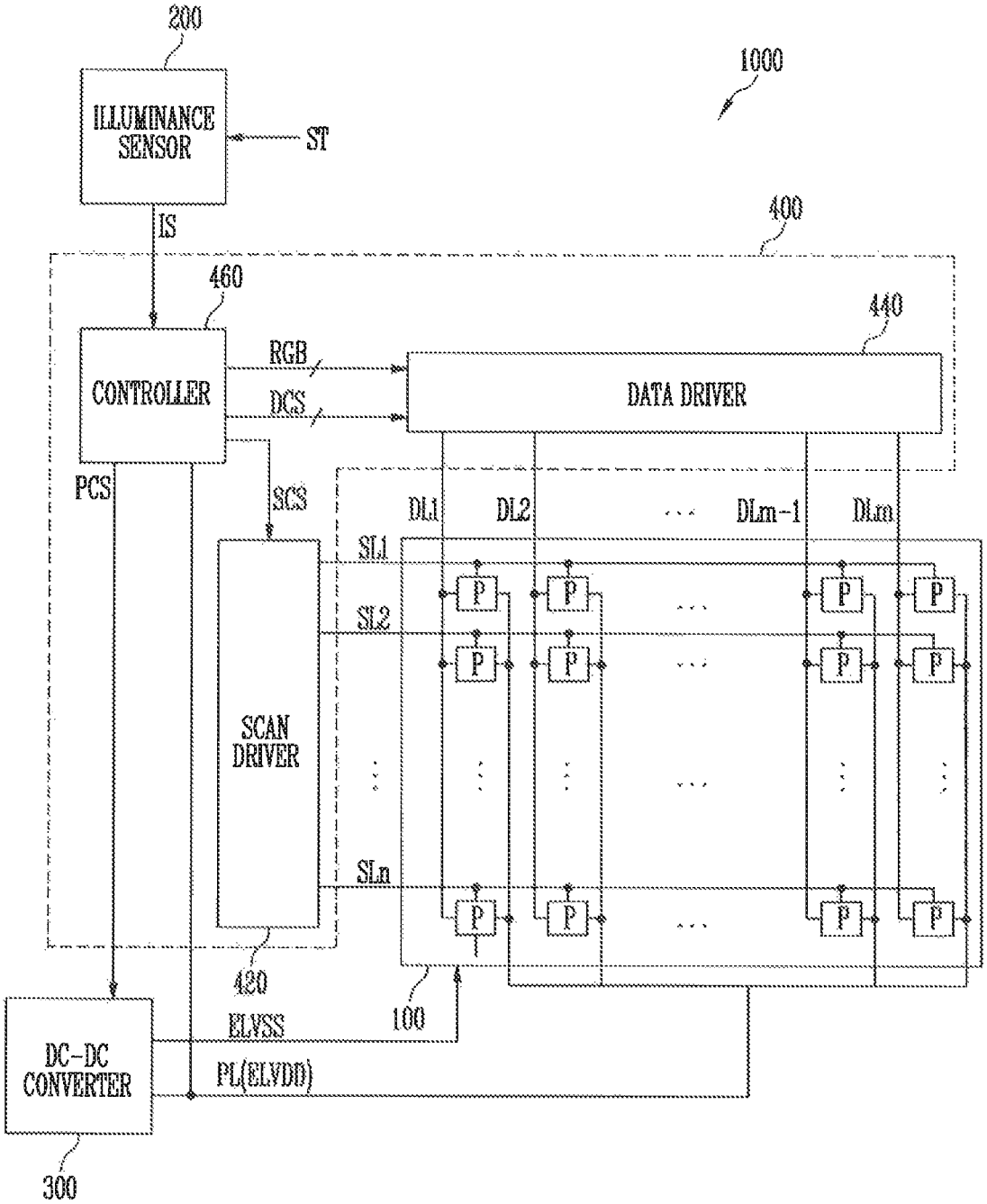
FIG. 1 is a block diagram of a display device according to an exemplary embodiment of the inventive concept.
Figure 2:
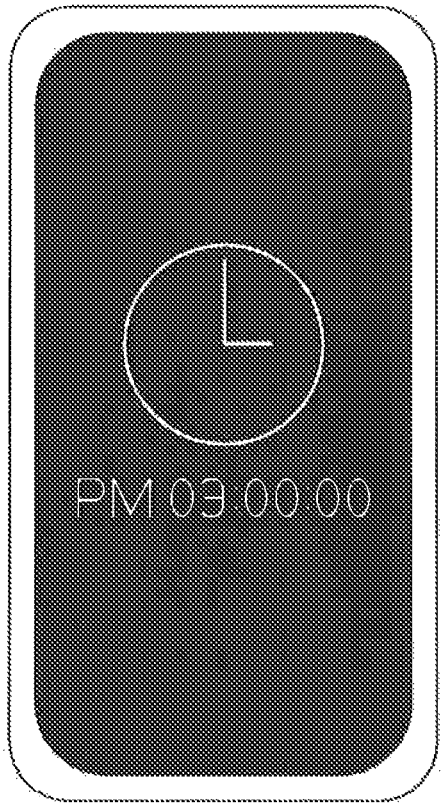
FIG. 2 is a diagram illustrating a screen displayed by the display device of FIG. 1 in an always display mode, according to an exemplary embodiment of the inventive concept.

FIG. 1 is a block diagram of a display device according to an exemplary embodiment of the inventive concept. FIG. 2 is a diagram illustrating a screen displayed by the display device of FIG. 1 in an always display mode, according to an exemplary embodiment of the inventive concept.

Referring to FIGS. 1 and 2, the display device 1000 may include a display panel 100, an illuminance sensor 200, a direct current (DC)-DC converter 300, and a display panel driver 400.

The display device 1000 may be an organic light emitting display device, a liquid crystal display device, or the like. The display device 1000 may be a flat display device, a flexible display device, a curved display device, a foldable display device, or a bendable display device. Further, the display device 1000 may be used as a transparent display device, a head-mounted display device, a wearable display device, and the like.

The display panel 100 may include a plurality of scan lines SL1 to SLn and a plurality of data lines DL1 to DLm. The display panel 100 may further include a plurality of pixels P respectively connected to the scan lines SL1 to SLn and the data lines DL1 to DLm, wherein n and m are integers greater than 1. In an exemplary embodiment of the inventive concept, the display panel 100 may further include emission control lines for applying emission control signals to each of the pixels P.

The display panel 100 may be driven in a normal mode or an always display mode. The normal mode may be a driving mode in which the display panel 100 normally displays an image corresponding to input image data. For example, in the normal mode, a general image or a video may be displayed according to a user's command input or the like.

The always display mode may be a mode (for example, an always on display (AOD) mode) in which basic display information is always displayed when the display device 1000 is in the standby state. For example, as illustrated in FIG. 2, in the always display mode, the display panel 100 may display the current time. However, the always display information may be an image set by the user. The always display mode may limit a maximum luminance of the display panel 100 and minimize the power consumption in the standby state of the display device 1000.

However, since a conventional always display mode displays an image at an extremely low luminance, for example, a luminance of about 2 to 5 nits (cd/m$^2$), the display information may not be visually recognized by a user in an environment where the ambient light is strong due to sunlight or the like. The display device 1000 according to an exemplary embodiment of the inventive concept may, however, change the luminance in such an environment. For example, the display device 1000 may change the luminance of the display panel 100 by changing a power supply voltage supplied to the pixels P in accordance with the illuminance of the ambient light in the always display mode.

The illuminance sensor 200 may detect the illuminance of the ambient light of the display device 1000. The illuminance sensor 200 may detect the illuminance and generate illuminance data IS. The illuminance sensor 200 may provide the illuminance data IS to a controller 460.

In an exemplary embodiment of the inventive concept, the illuminance sensor 200 may be embedded in a system board external to the display device 1000, or may be embedded in the display panel driver 400. Alternatively, the illuminance sensor 200 may be configured in the display device 1000 with a separate circuit or chip.

The illuminance sensor 200 may detect the illuminance based on a detection start signal ST indicating when the illuminance should be detected. The detection start signal ST may be generated every predetermined period based on a predetermined clock signal.

The DC-DC converter 300 may generate a first power supply voltage ELVDD based on a power supply control signal PCS. The first power supply voltage ELVDD may be supplied to each of the pixels P through a power supply line PL. In an exemplary embodiment of the inventive concept, the DC-DC converter 300 may further generate a second power supply voltage ELVSS and supply the second power voltage ELVSS to the display panel 100. The first power supply voltage ELVDD may be a driving voltage supplied to one electrode of a driving transistor of the pixel P and the second power supply voltage ELVSS may be a common voltage applied to a cathode of an organic light emitting diode, for example.

In an exemplary embodiment of the inventive concept, in the always display mode, the DC-DC converter 300 may supply the first power supply voltage ELVDD having a first voltage level to the pixels P through the pixel line PL when the illuminance is greater than a predetermined reference value. For example, the first voltage level may range from about 4V to about 6V. The display panel 100 may display the always display image at a luminance of about 300 nit or more based on the first voltage level of the first power supply voltage ELVDD. However, this is merely exemplary, and a magnitude of the first voltage level and the luminance of the display panel 100 in the always display mode are not limited thereto.

In an exemplary embodiment of the inventive concept, the DC-DC converter 300 may be disabled when the illuminance in the always display mode is less than or equal to the predetermined reference value. In this case, the operation of the DC-DC converter 300 may be stopped.

The display panel driver 400 may supply the first power voltage ELVDD having a second voltage level to the pixels P through the power supply line PL when the illuminance is less than or equal to the predetermined reference value in the always display mode. In an exemplary embodiment of the inventive concept, the second voltage level may be less than the first voltage level, and thus, the maximum luminance of the display panel 100 may be reduced.

The display panel driver 400 may provide a scan signal and a data signal to the pixels P. In an exemplary embodiment of the inventive concept, the display panel driver 400 may include a scan driver 420 for supplying the scan signal, a data driver 440 for supplying the data signal, and the controller 460 for controlling the scan driver 420 and the data driver 440.

In an exemplary embodiment of the inventive concept, the scan driver 420, the data driver 440, and the controller 460 may be integrated into one driving circuit chip. In an exemplary embodiment of the inventive concept, the scan driver 420 may be directly disposed on the display panel 100, and the data driver 440 and the controller 460 may be integrated on the display panel 100 in a one-chip form. However, these are merely examples, and the configuration and arrangement of the display panel driver 400 are not limited thereto.

The display panel driver 400 may further include an emission driver for controlling light emission of each of the pixels P.

The controller 460 may control the scan driver 420 and the data driver 440. For example, the controller 460 may include a timing controller for controlling operation timings of the scan driver 420 and the data driver 440.

In an exemplary embodiment of the inventive concept, the controller 460 may receive an RGB (red, green, blue) image signal, a vertical synchronizing signal, a horizontal synchronizing signal, a main clock signal, and a data enable signal from an external graphic controller and generate a scan control signal SCS, a data control signal DCS, and image data RGB corresponding to the RGB image signal.

The controller 460 may generate the power supply control signal PCS for controlling the operation of the DC-DC converter 300 based on the illuminance data IS received from the illuminance sensor 200.

The controller 460 may supply the first power supply voltage ELVDD to the power supply line PL based on a DC voltage supplied to the data driver 400 or a gate high voltage of the scan signal when the illuminance is less than or equal to the predetermined reference value in the always display mode. In other words, when the illuminance in the always display mode is less than or equal to the predetermined reference value, the display panel driver 400 or the controller 460 may be used in place of the DC-DC converter 300 to supply the first power voltage ELVDD having the second voltage level to the display panel 100. In an exemplary embodiment of the inventive concept, the second voltage level may range from about 2V to about 3V. The display panel 100 may display the always display image at a luminance of about 10 nit or less based on the second voltage level of the first power supply voltage ELVDD. However, this is just an example, and the magnitude of the second voltage level and the luminance of the display panel 100 in the always display mode are not limited thereto. In addition, the first power supply voltage ELVDD is not limited to being supplied to the power supply line PL from the controller 460. For example, any component included in the display panel driver 400 may supply the first power voltage ELVDD to the power supply line PL.

The scan driver 420 may provide the scan signal to the scan lines SL1 to SLn based on the scan control signal SCS. In an exemplary embodiment of the inventive concept, the scan driver 420 may simultaneously supply the scan signal (e.g., the scan signal having a gate-on level) to all of the pixels P, or may sequentially provide the scan signal to the pixels P in the display panel 100.

The data driver 440 may provide the data signal (e.g., a data voltage) to the data lines DL1 to DLm based on the data control signal DCS and the image data RGB provided from the controller 460. For example, the data driver 440 may convert the image data RGB of a digital format into the data signals of an analog format, and may output the data signals to the pixels P through the first to m-th data lines DL1 to DLm.

Figure 3:
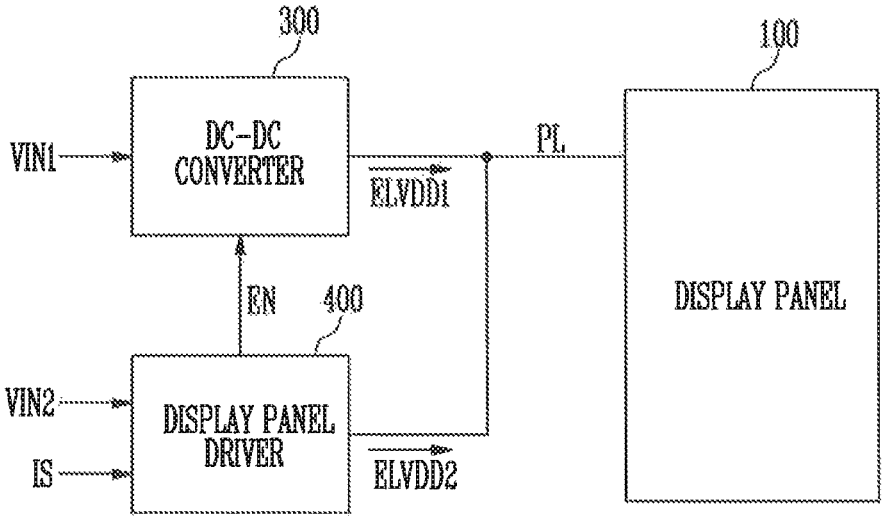
FIG. 3 is a block diagram for explaining an operation of the display device of FIG. 1, according to an exemplary embodiment of the inventive concept.

FIG. 3 is a block diagram for explaining an operation of the display device 1000 of FIG. 1, according to an exemplary embodiment of the inventive concept.

FIGS. 1 to 3, the DC-DC converter 300 or the display panel driver 400 may selectively supply a power supply voltage ELVDD1 or ELVDD2 to the display panel 100 according to the driving mode of the display panel 100 and the ambient illuminance of the display panel 100.

The DC-DC converter 300 may generate and output the power supply voltage ELVDD1 having a first voltage level based on a first DC voltage VIN1 received from the outside of the display device 1000. The power supply voltage ELVDD1 may be supplied to the pixels P included in the display panel 100 through the power supply line PL. For example, the DC voltage VIN1 may be a DC voltage output from a DC voltage source such as a battery outside the display device 1000.

In an exemplary embodiment of the inventive concept, the driving of the DC-DC converter 300 may be controlled by an enable signal EN output from the display panel driver 400. In the always display mode, when the illuminance is less than or equal to the predetermined reference value, the DC-DC converter 300 may be disabled and the operation of the DC-DC converter 300 may be stopped. For example, an electrical connection between the DC-DC converter 300 and the DC power source (e.g., the first DC voltage VIN1) may be disconnected. In addition, the DC-DC converter 300 may be electrically disconnected from the power supply line PL.

The DC-DC converter 300 may receive the enable signal EN and generate the power supply voltage ELVDD1 when the illuminance in the always display mode is greater than the predetermined reference value. For example, the first voltage level may range from about 4V to about 6V. The display panel 100 may display the always display image at a luminance of about 300 nit or more based on the first voltage level of the power supply voltage ELVDD1. Therefore, the always display image may be easily recognized in a bright environment, for example, a bright outdoors environment.

In an exemplary embodiment of the inventive concept, the DC-DC converter 300 may generate and output the power supply voltage ELVDD1 regardless of the change in the illuminance when the display panel 100 operates in the normal mode.

The display panel driver 400 may supply the power supply voltage ELVDD2 having a second voltage level different from the first voltage level to the pixels p through the power supply line PL when the illuminance is less than or equal to the predetermined reference value in the always display mode. The display panel driver 400 may receive the illuminance data IS detected by the illuminance sensor 200.

In an exemplary embodiment of the inventive concept, the display panel driver 400 may generate the enable signal EN based on the illuminance data IS. For example, the display panel driver 400 may include a comparator that compares the illuminance included in the illuminance data IS with the predetermined reference value and outputs the enable signal EN. The DC-DC converter 300 may be enabled by the enable signal EN when the illuminance is greater than the predetermined reference value.

The display panel driver 400 may receive a second DC voltage VIN2 from the DC voltage source such as an external battery or the like. For example, the second DC voltage VIN2 may be about 10V. Here, the second DC voltage VIN2 may be equal to the first DC voltage VIN1. The display panel driver 400 may generate voltages output from the timing controller 460, the data driver 440, and/or the scan driver 420 based on the second DC voltage VIN2. For example, a gate high voltage or a gate low voltage of the scan signal may be generated based on the second DC voltage VIN2, or a gamma reference voltage for generating a gamma voltage may be generated based on the second DC voltage VIN2.

In the always display mode, when the illuminance is less than or equal to the predetermined reference value, the display panel driver 400 may output the power supply voltage ELVDD2 having the second voltage level to the power supply line PL. In this case, the DC-DC converter 300 may be disconnected from the power supply line PL.

In an exemplary embodiment of the inventive concept, the power supply voltage ELVDD2 having the second voltage level may be generated from the gate high voltage of the scan signal. For example, the power supply voltage ELVDD2 may have substantially the same voltage level as the gate high voltage of the scan signal. Alternatively, the gate high voltage of the scan signal may be lowered to a predetermined value by a diode or the like, and the lowered voltage may be output as the second voltage level of the power supply voltage ELVDD2.

In an exemplary embodiment of the inventive concept, the power supply voltage ELVDD2 having the second voltage level may be generated from a DC voltage supplied to the data driver 440. For example, the power supply voltage ELVDD2 having the second voltage level may be generated by the gamma reference voltage for generating the gamma voltage, a high-potential voltage for driving the data driver 440, or the like.

The power supply voltage ELVDD2 having the second voltage level may be set to about 2V to about 3V. The display panel 100 may display the always display image at a luminance of about 10 nit or less based on the power supply voltage ELVDD2 having the second voltage level.

In an exemplary embodiment of the inventive concept, when the display device 1000 and the battery are connected to an external charging source, the always display image may be displayed by using the external charging source regardless of the ambient illuminance, and thus, the maximum luminance may be increased. In this case, the external charging source may be directly provided to the display device 1000.

As described above, the display device 1000 according to an exemplary embodiment of the inventive concept may select one of the DC-DC converter 300 and the display panel driver 400 in response to the illuminance change in the always display mode to supply the power supply voltage ELVDD1 or ELVDD2 to the display panel 100. Therefore, in a low-illuminance environment, the power supply voltage ELVDD2 may be supplied using the DC voltage of the display panel driver 400 that outputs the data voltage and the scan signal, thereby reducing power losses due to the driving of the DC-DC converter 300. Further, in a high-illuminance environment, the maximum luminance of the always display mode may be increased by driving the DC-DC converter 300 so that the visibility of the always display image in the high-illuminance environment can be increased.

Figure 4:
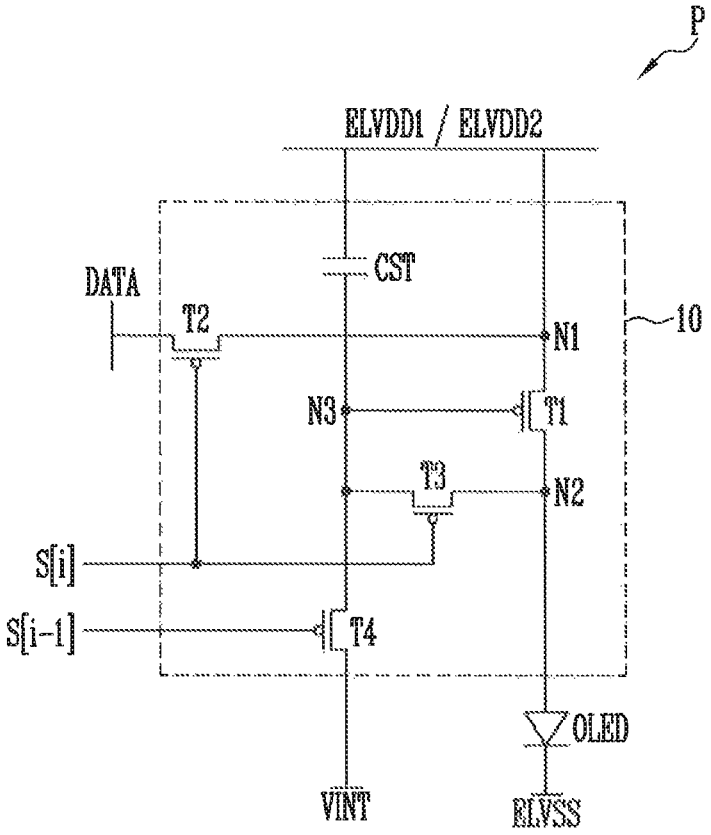
FIG. 4 is a circuit diagram illustrating a pixel included in the display device of FIG. 1, according to an exemplary embodiment of the inventive concept.

FIG. 4 is a circuit diagram illustrating a pixel P included in the display device 1000 of FIG. 1, according to an exemplary embodiment of the inventive concept.

Referring to FIGS. 3 and 4, the pixel P may include a pixel circuit 10 and an organic light emitting diode OLED.

An anode electrode of the organic light emitting diode OLED may be connected to the pixel circuit 10 and a cathode electrode of the organic light emitting diode OLED may be connected to a second power supply supplying the second power supply voltage ELVSS. The organic light emitting diode OLED may generate light of a predetermined luminance corresponding to an amount of current supplied from the pixel circuit 10.

The pixel circuit 10 may control the amount of current flowing from the power supply line (shown as PL in FIG. 3) supplying the first power supply voltage ELVDD1 or ELVDD2 to the second power supply via the organic light emitting diode OLED corresponding to a data voltage DATA. The pixel circuit 10 may include first, second, third and fourth transistors T1, T2, T3 and T4 and a storage capacitor CST.

The first transistor T1 may be coupled between a first node N1 electrically connected to the power supply line PL and a second node N2 electrically connected to the anode electrode of the organic light emitting diode OLED. The first transistor T1 may generate a driving current and provide the driving current to the organic light emitting diode OLED. A gate electrode of the first transistor T1 may be coupled to a third node N3. The first transistor T1 may function as a driving transistor of the pixel P.

The second transistor T2 may be coupled between a data line and the first node N1. The second transistor T2 may include a gate electrode for receiving a scan signal S[i]. When the second transistor T2 is turned on, the data voltage DATA may be transferred to the first node N1. In other words, the second transistor T2 may be a scan transistor for transmitting the data voltage DATA to the pixel circuit 10 by scanning the scan signal S[i].

The third transistor T3 may be coupled between the second node N2 and the third node N3. The third transistor T3 may include a gate electrode for receiving the scan signal S[i]. The third transistor T3 may be turned on by the scan signal S[i] to electrically connect a second electrode of the first transistor T1 and the third node N3. Therefore, when the third transistor T3 is turned on, the first transistor T1 may be connected in a diode form. In other words, the third transistor T3 may perform a data voltage DATA write operation and a threshold voltage compensation for the first transistor T1.

The fourth transistor T4 may be coupled between an initialization power supply VINT and the third node. The initialization power supply VINT outputs a predetermined DC voltage. The fourth transistor T4 may include a gate electrode for receiving a previous scan signal S[i−1]. The fourth transistor T4 may be turned on by the previous scan signal S[i−1] to transfer the voltage of the initialization power supply VINT to the gate electrode of the first transistor T1. In other words, the fourth transistor T4 may serve to initialize a gate voltage of the first transistor T1 to a predetermined voltage level. In an exemplary embodiment of the inventive concept, the initialization power supply VINT may be generated in the display panel driver 400.

The storage capacitor CST may be connected between the first power supply and the third node N3. The storage capacitor CST may store a voltage corresponding to the data voltage DATA and the threshold voltage of the first transistor T1.

The configuration of the pixel circuit 10 is not limited to that shown in FIG. 4. For example, the pixel circuit 10 may further include a transistor for initializing an anode voltage of the organic light emitting diode OLED, a transistor for controlling an emission of the organic light emitting diode OLED, and the like.

In the always display mode, the DC-DC converter 300 may supply the first power supply voltage ELVDD1 having the first voltage level or the display panel driver 400 may supply the first power voltage ELVDD2 having the second voltage level, according to the ambient illuminance. Accordingly, the maximum luminance of the display panel 100 may be changed according to the illuminance while the power consumption is minimized.

Figure 5:
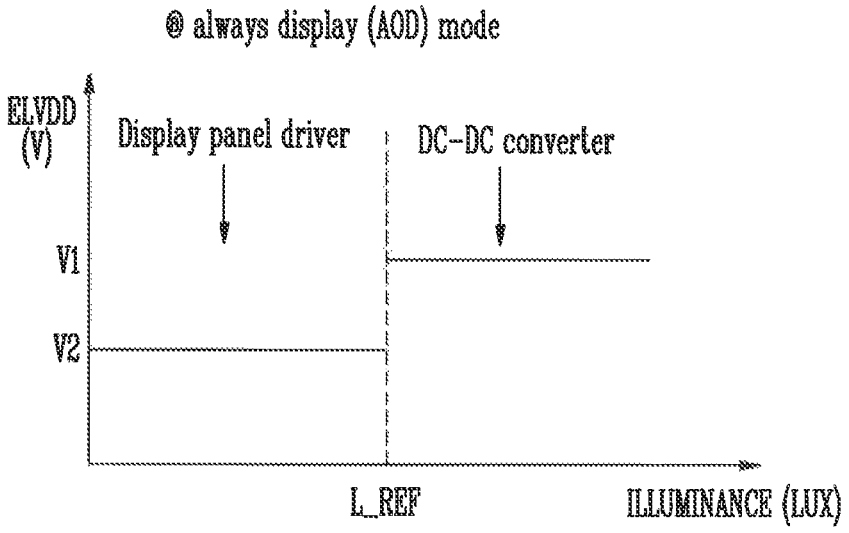
FIG. 5 is a diagram illustrating a power supply voltage supplied to a pixel of the display device of FIG. 1 in an always display mode, according to an exemplary embodiment of the inventive concept.

FIG. 5 is a diagram illustrating a power supply voltage ELVDD supplied to a pixel P of the display device 1000 of FIG. 1 in an always display mode, according to an exemplary embodiment of the inventive concept.

Referring to FIG. 5, in the always display mode, the power supply voltage ELVDD of the pixel P may be supplied from the display panel driver 400 or the DC-DC converter 300 based on the illuminance.

The power supply voltage ELVDD having the second voltage level V2 generated by the display panel driver 400 may be supplied to the pixels P when the illuminance detected by the illuminance sensor 200 is less than or equal to a predetermined reference value L_REF. The second voltage level V2 may be in the range of about 2V to about 3V. Here, the maximum luminance of the display panel 100 may be about 10 nit or less.

The predetermined reference value L_REF may be set to about 10,000 lux. 10000 lux corresponds to a daytime exterior illumination without direct sunlight. Alternatively, the predetermined reference value L_REF may be set to about 30,000 lux which is an external illuminance level by direct sunlight.

When the illuminance detected by the illuminance sensor 200 is greater than the predetermined reference value L_REF, the power supply voltage ELVDD having the first voltage level V1 generated by the DC-DC converter 300 may be supplied to the pixels P. The first voltage level V1 may be in the range of about 4V to about 6V. In other words, the first voltage level V1 may be set greater than the second voltage level V2. Here, the maximum luminance of the display panel 100 may be about 300 nit or more. Therefore, the maximum luminance by the power supply voltage supply of the DC-DC converter 300 may be greater than the maximum luminance by the supply voltage supply of the display panel driver 400.

Thus, the display device 1000 may have both the power consumption reduction in the always display mode and the visibility enhancement corresponding to the change in external light.

Figure 6:
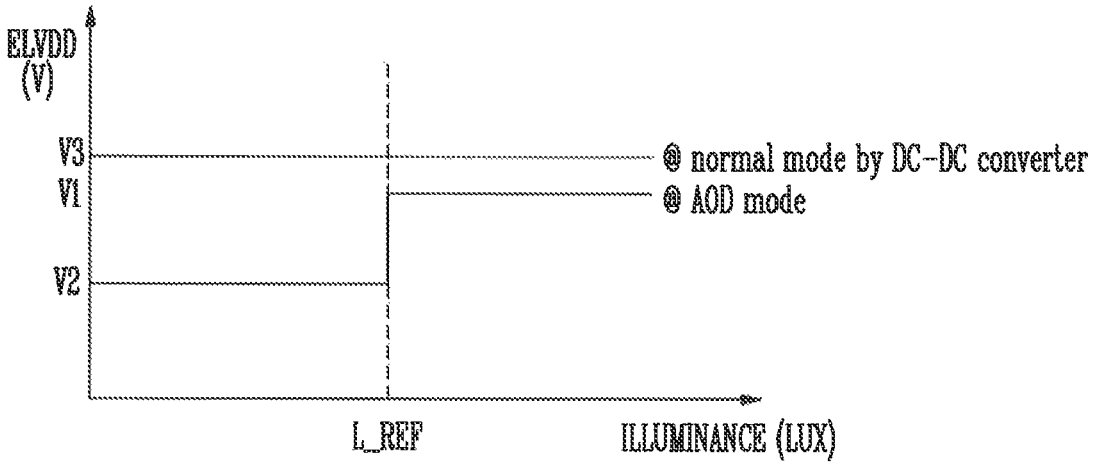
FIG. 6 is a diagram illustrating a power supply voltage supplied to a pixel of the display device of FIG. 1 in an always display mode and a normal mode, according to an exemplary embodiment of the inventive concept.

FIG. 6 is a diagram illustrating a power supply voltage ELVDD supplied to a pixel P of the display device 1000 of FIG. 1 in an always display mode and a normal mode, according to an exemplary embodiment of the inventive concept.

Referring to FIG. 6, in the normal mode, only the DC-DC converter 300 may supply the power supply voltage ELVDD to the pixels P. In the always display mode, one of the display panel driver 400 and the DC-DC converter 300 may selectively supply the power supply voltage ELVDD according to the illuminance.

In an exemplary embodiment of the inventive concept, a voltage level V3 of the power supply voltage ELVDD in the normal mode may be set to be greater than the first voltage level V1. In other words, the maximum luminance in the normal mode is greater than the maximum luminance in the always display mode. However, this is merely exemplary, and the voltage level V3 of the power source voltage ELVDD in the normal mode may be substantially the same as the first voltage level V1.

Figure 7:
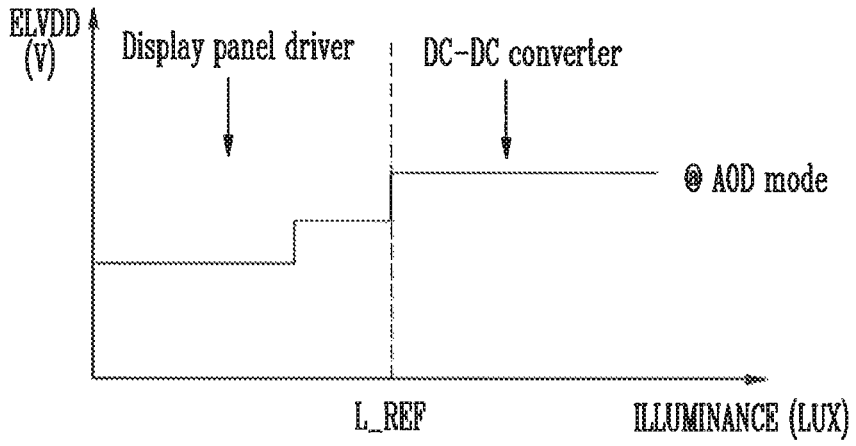
FIG. 7 is a diagram illustrating a power supply voltage supplied to a pixel of the display device of FIG. 1 in an always display mode, according to an exemplary embodiment of the inventive concept.

FIG. 7 is a diagram illustrating a power supply voltage ELVDD supplied to a pixel P of the display device 1000 of FIG. 1 in an always display mode, according to an exemplary embodiment of the inventive concept.

Referring to FIG. 7, in the always display mode, one of the display panel driver 400 and the DC-DC converter 300 may selectively supply the power supply voltage ELVDD according to the illuminance.

In an exemplary embodiment of the inventive concept, when the display panel 100 is in the always display mode and the illuminance is less than or equal to the predetermined reference value L_REF, the magnitude of the power supply voltage ELVDD may be reduced as the illuminance is reduced. For example, as illustrated in FIG. 7, the power supply voltage ELVDD may be changed into a step function corresponding to predetermined illuminances. Therefore, at the illuminance less than the predetermined reference value, the lower the illuminance, the lower the maximum luminance of the display panel 100. However, this is merely an example, and the change of the power supply voltage ELVDD is not limited thereto. For example, the power supply voltage ELVDD output from the display panel driver 400 may be changed to have a linear function form or an exponential function form.

As described above, since the power supply voltage ELVDD and the maximum luminance of the display panel 100 are reduced as the illuminance is lowered, the power consumption of the display device 1000 may be further reduced.

Figure 8A:
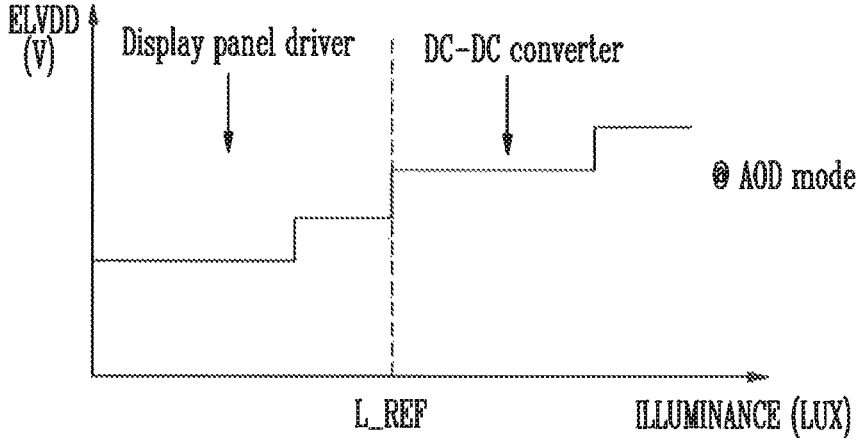
FIG. 8A is a diagram illustrating a power supply voltage supplied to a pixel of the display device of FIG. 1 in an always display mode, according to an exemplary embodiment of the inventive concept.
Figure 8B:
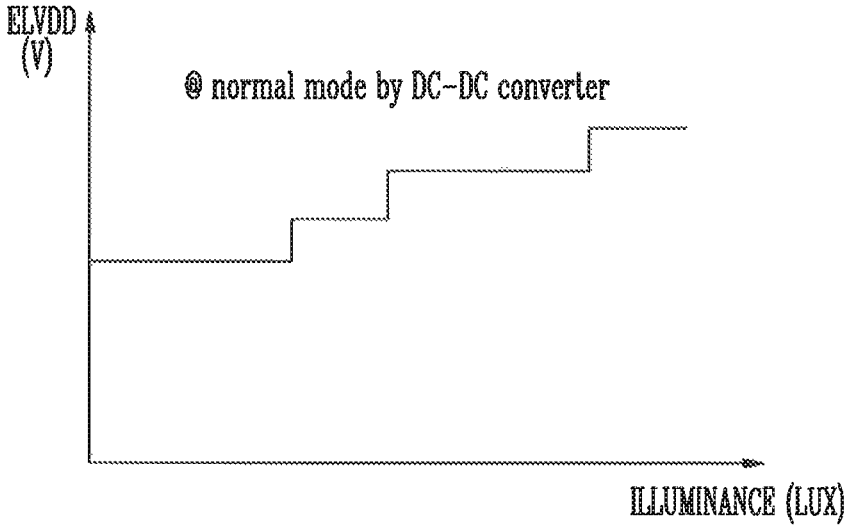
FIG. 8B is a diagram illustrating a power supply voltage supplied to a pixel of the display device of FIG. 1 in a normal mode, according to an exemplary embodiment of the inventive concept.

FIG. 8A is a diagram illustrating a power supply voltage ELVDD supplied to a pixel P of the display device 1000 of FIG. 1 in an always display mode, according to an exemplary embodiment of the inventive concept. FIG. 8B is a diagram illustrating a power supply voltage ELVDD supplied to a pixel P of the display device 1000 of FIG. 1 in a normal mode, according to an exemplary embodiment of the inventive concept.

Referring to FIGS. 8A and 8B, only the DC-DC converter 300 may supply the power supply voltage ELVDD to the pixels P in the normal mode. In the always display mode, one of the display panel driver 400 and the DC-DC converter 300 may selectively supply the power supply voltage ELVDD according to the illuminance.

Since operations of the display panel driver 400 were described above with reference to FIG. 7, duplicate descriptions will be omitted.

When the display panel 100 is in the always display mode and the illuminance is greater than the predetermined reference value L_REF, the lower the illuminance, the lower the power supply voltage ELVDD output from the DC-DC converter. For example, as illustrated in FIG. 8A, the power supply voltage ELVDD may be changed into a step function corresponding to predetermined illuminances. Therefore, at the illuminance greater than the predetermined reference value L_REF, the lower the illuminance, the lower the maximum luminance of the display panel 100. In addition, at the illuminance greater than the predetermined reference value L_REF, the higher the illuminance, the higher the maximum luminance of the display panel 100. Since this is an example, the change of the power supply voltage ELVDD is not limited thereto. For example, the power supply voltage ELVDD output from the display panel driver 400 may be changed to have a linear function form or an exponential function form.

As described above, since the power supply voltage ELVDD1 and the maximum luminance of the display panel 100 are stepwise adjusted in accordance with the change in the illuminance, the power consumption of the display device 1000 may be further reduced.

Figure 9:
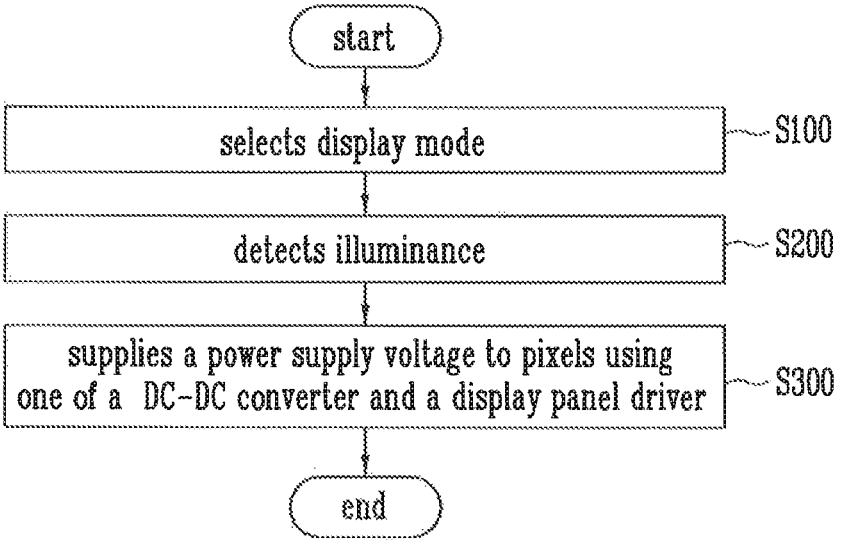
FIG. 9 is a flow chart of a method for driving a display device according to an exemplary embodiment of the inventive concept.
Figure 10:
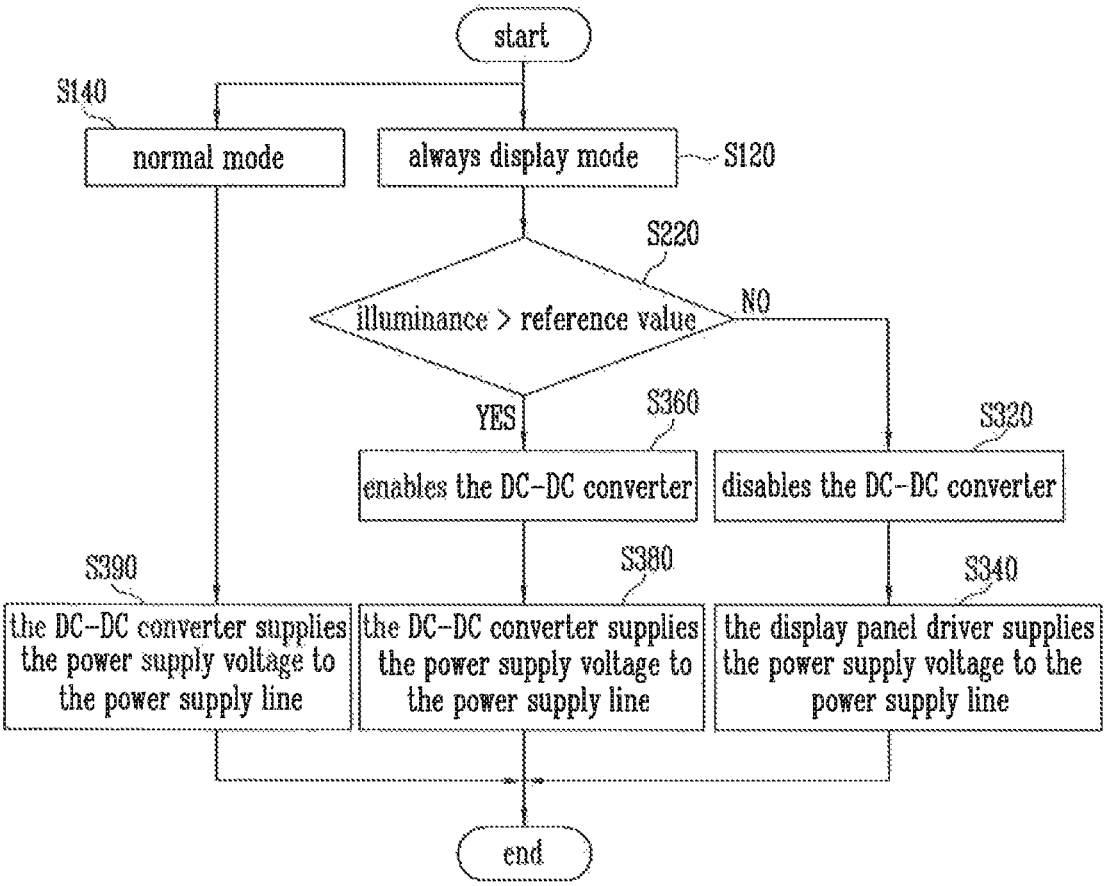
FIG. 10 is a flow chart illustrating the method for driving the display device of FIG. 9, according to an exemplary embodiment of the inventive concept.

FIG. 9 is a flow chart of a method for driving a display device according to an exemplary embodiment of the inventive concept. FIG. 10 is a flow chart illustrating the method for driving the display device of FIG. 9, according to an exemplary embodiment of the inventive concept.

Referring to FIGS. 9 and 10, the method for driving the display device 1000 may include selecting one of a normal mode for displaying a general image and an always display mode for displaying an always display image S100, detecting an illuminance of ambient light in the always display mode S200; and supplying a power supply voltage ELVDD to a plurality of pixels P by selecting one of a DC-DC converter 300 and a display panel driver 400 in response to the selected mode and the detected illuminance S300.

The display panel 100 may display an image in the normal mode S140 or the always display mode S120. For example, when a user views an image or handles the display device 1000, the display panel 100 is driven in the normal mode. When the user does not use the display device 1000, the display panel 100 may be driven in the always display mode S120.

The illuminance of the ambient light may be detected in the always display mode, and the illuminance and the predetermined reference value may be compared S220. For example, the predetermined reference value may be a value corresponding to a low external illuminance.

When the illuminance is greater than the predetermined reference value in the always display mode, the DC-DC converter 300 may be enabled S360. Accordingly, the DC-DC converter 300 that receives a DC power from a voltage source such as an external battery may supply a power supply voltage ELVDD having a first voltage level to the pixels P through a power supply line PL S380. In addition, the direct connection between the display panel driver 400 and the power supply line PL may be cut off.

In the always display mode, when the illuminance is less than or equal to the predetermined reference value, the DC-DC converter 300 may be disabled S320. For example, the DC-DC converter 300 may be disconnected from the power supply line PL. In other words, the operation of the DC-DC converter 300 may be stopped. In this case, the display panel driver 400 may be connected to the power supply line PL, and the power supply voltage ELVDD having a second voltage level may be supplied to the pixels P through the power supply line PL S340. The display panel driver 400 may be a one-chip type driving integrated circuit chip including the data driver 440, the timing controller 460 and the like. For example, the power supply voltage output from the display panel driver 400 may be generated from a gate high voltage of the scan signal or a DC voltage input to the display panel driver 400.

The maximum luminance by the voltage supply from the DC-DC converter 300 may be greater than the maximum luminance by the voltage supply from the display panel driver 400. For example, the second voltage level may be set to be lower than the first voltage level, and the power supply voltage ELVDD may correspond to a driving voltage transmitted to the driving transistor of each of the pixels P. Therefore, the DC-DC converter 300 may operate in a high-illuminance environment so that the luminance of the display panel 100 increases to improve visibility.

When the display panel 100 is in the normal mode S140, the DC-DC converter 300 may supply the power supply voltage ELVDD to the pixels P through the power supply line PL S390. The direct connection between the display panel driver 400 and the power supply line PL may be cut off. In an exemplary embodiment of the inventive concept, the magnitude of the power supply voltage ELVDD supplied from the DC-DC converter 300 may be adjusted according to the illuminance change. For example, the lower the illuminance, the lower the power supply voltage ELVDD, and the maximum luminance of the display panel 100 may be reduced (e.g., lowered). Therefore, the power consumption of the display device 1000 in the low-illuminance environment may be reduced.

Exemplary embodiments of the inventive concept provide a display device for controlling a power supply voltage supply based on a mode of a display panel and an illuminance of the display panel. For example, as described above, the display device and the method for the display device according to exemplary embodiments of the inventive concept may select one of the DC-DC converter and the display panel driver according to the illuminance change in the always display mode to supply the power supply voltage corresponding to the driving voltage of the display panel to the display panel. Therefore, in the low-illuminance environment, power loss due to driving of the DC-DC converter may be eliminated. Further, in the high-illuminance environment, the maximum luminance of the always display mode may be increased by driving the DC-DC converter so that the visibility of the always display image in the high-illuminance environment may be greatly increased.

Exemplary embodiments of the inventive concept may be applied to any display device that can be driven in the always display mode (or a lower power mode) and any electronic device including the display device. For example, exemplary embodiments of the inventive concept may be applied to a television (TV), a computer monitor, a three-dimensional (3D) TV, a laptop, a digital camera, a cellular phone, a smart phone, a smart pad, a personal digital assistant (PDA), a portable multimedia player (PMP), a MP3 player, a navigation system, a game console, a video phone, a wearable display device, etc.

While the inventive concept has been particularly shown and described with reference to exemplary embodiments thereof, those skilled in the art will readily appreciate that many modifications are possible without departing from the spirit and scope of the inventive concept as defined in the claims.

What is claimed is:

1. A display device, comprising:

a display panel including a plurality of pixels configured to be driven in a normal mode or an always on display mode;

an illuminance sensor configured to detect illuminance of ambient light;

a direct current (DC)-DC converter configured to supply a power supply voltage having a first voltage level to the pixels through a power supply line when the illuminance is greater than a predetermined reference value in the always on display mode; and a display panel driver configured to supply a power supply voltage having a second voltage level to the pixels through the power supply line when the illuminance is less than or equal to the predetermined reference value in the always on display mode, wherein the display panel driver generates an enable signal based on the illuminance of ambient light to enable the DC-DC converter in the always on display mode, and wherein the DC-DC converter is enabled to supply the power supply voltage having the first voltage level in response to the enable signal provided from the display panel driver.

2. The display device of claim 1, wherein the DC-DC converter is disabled when the illuminance is less than or equal to the predetermined reference value in the always on display mode.

3. The display device of claim 2, wherein the display panel driver is electrically disconnected from the power supply line when the illuminance is greater than the predetermined reference value in the always on display mode.

4. The display device of claim 1, wherein a maximum luminance of the display panel when the DC-DC converter supplies the power supply voltage is higher than a maximum luminance of the display panel when the display panel driver supplies the power supply voltage.

5. The display device of claim 1, wherein the second voltage level is less than the first voltage level.

6. The display device of claim 1, wherein the DC-DC converter supplies the power supply voltage to the power supply line in the normal mode, and wherein the display panel driver is electrically disconnected from the power supply line in the normal mode.

7. The display device of claim 1, wherein the display panel driver comprises:

a scan driver configured to supply a scan signal to the pixels through a plurality of scan lines;

a data driver configured to supply a data signal to the pixels through a plurality of data lines; and a controller configured to control the scan driver and the data driver.

8. The display device of claim 7, wherein the power supply voltage supplied from the display panel driver is generated from a gate high voltage of the scan signal.

9. The display device of claim 7, wherein the power supply voltage supplied from the display panel driver is generated from a DC voltage provided to the data driver.

10. The display device of claim 1, wherein the display panel driver changes a magnitude of the power supply voltage according to an illuminance change when the illuminance is less than or equal to the predetermined reference value in the always on display mode.

11. The display device of claim 10, wherein the power supply voltage is reduced as the illuminance is reduced, when the illuminance is less than or equal to the predetermined reference value in the always on display mode.

12. The display device of claim 10, wherein a maximum luminance is reduced as the illuminance is reduced, in the always on display mode.

13. The display device of claim 1, wherein the DC-DC converter controls a magnitude of the power supply voltage according to the illuminance.

14. The display device of claim 13, wherein the power supply voltage output from the DC-DC converter is reduced as the illuminance is reduced, in the normal mode.

15. A method for driving a display device, comprising:

selecting one of a normal mode and an always on display mode;

detecting an illuminance of ambient light in the always on display mode; and supplying a power supply voltage to a plurality of pixels by using one of a direct current (DC)-DC converter and a display panel driver in response to the selected mode and the detected illuminance, wherein the DC-DC converter is enabled to supply the power supply voltage in the always on display mode by the display panel driver.

16. The method of claim 15, wherein when supplying the power supply voltage to the pixels, the DC-DC converter supplies the power supply voltage having a first voltage level to the pixels through a power supply line when the illuminance is greater than a predetermined reference value in the always on display mode.

17. The method of claim 16, wherein when supplying the power supply voltage to the pixels, the display panel driver supplies the power supply voltage having a second voltage level to the pixels through the power supply line when the illuminance is less than or equal to the predetermined reference value in the always on display mode.

18. The method of claim 17, wherein a maximum luminance of the display panel when the DC-DC converter supplies the power supply voltage is higher than a maximum luminance of the display panel when the display panel driver supplies the power supply voltage.

19. The method of claim 18, wherein the second voltage level is less than the first voltage level, and the power supply voltage is transmitted to a driving transistor of each of the pixels.

20. The method of claim 15, wherein when supplying the power supply voltage to the pixels, the DC-DC converter supplies the power supply voltage to a power supply line in the normal mode and the display panel driver is electrically disconnected from the power supply line in the normal mode.

* * * * *